United States Patent [19]

Shettler

[11] Patent Number: 4,508,347

[45] Date of Patent: Apr. 2, 1985

[54] ALPHABET BLOCKS

[76] Inventor: Carol A. Shettler, 11977 E. Yale Ave., Aurora, Colo. 80014

[21] Appl. No.: 525,918

[22] Filed: Aug. 24, 1983

[51] Int. Cl.[3] ..... A63F 9/12

[52] U.S. Cl. ..... 273/157 R; 434/160

[58] Field of Search ..... 273/156, 157 R; 434/160; D20/12

[56] References Cited

U.S. PATENT DOCUMENTS

| | | | |
|---|---|---|---|
| D. 156,338 | 12/1949 | Holcomb | 273/157 R X |
| 176,532 | 4/1876 | Hughes | 273/157 R |
| 3,759,526 | 9/1973 | Estvan | 434/160 X |
| 4,216,964 | 8/1980 | Gans | 273/156 |

FOREIGN PATENT DOCUMENTS

| | | | |
|---|---|---|---|
| 94373 | 6/1969 | France | 273/157 R |
| 170062 | 12/1977 | Hungary | 273/153 S |
| 8000038 | 8/1981 | Netherlands | 273/157 R |

*Primary Examiner*—Anton O. Oechsle

*Attorney, Agent, or Firm*—Henderson & Sturm

[57] ABSTRACT

This invention relates to a combined educational puzzle and amusement device comprising a set of nine toy blocks that have various indicia imprinted on the sides of the individual blocks, in such a manner that the rotation and displacement of the individual blocks in a given pattern can produce all of the letters in the alphabet; the letters being formed on the combined top surface of the toy blocks, when the blocks are arranged in a grid, of three rows down, and three rows across.

30 Claims, 10 Drawing Figures

FIG. 1.
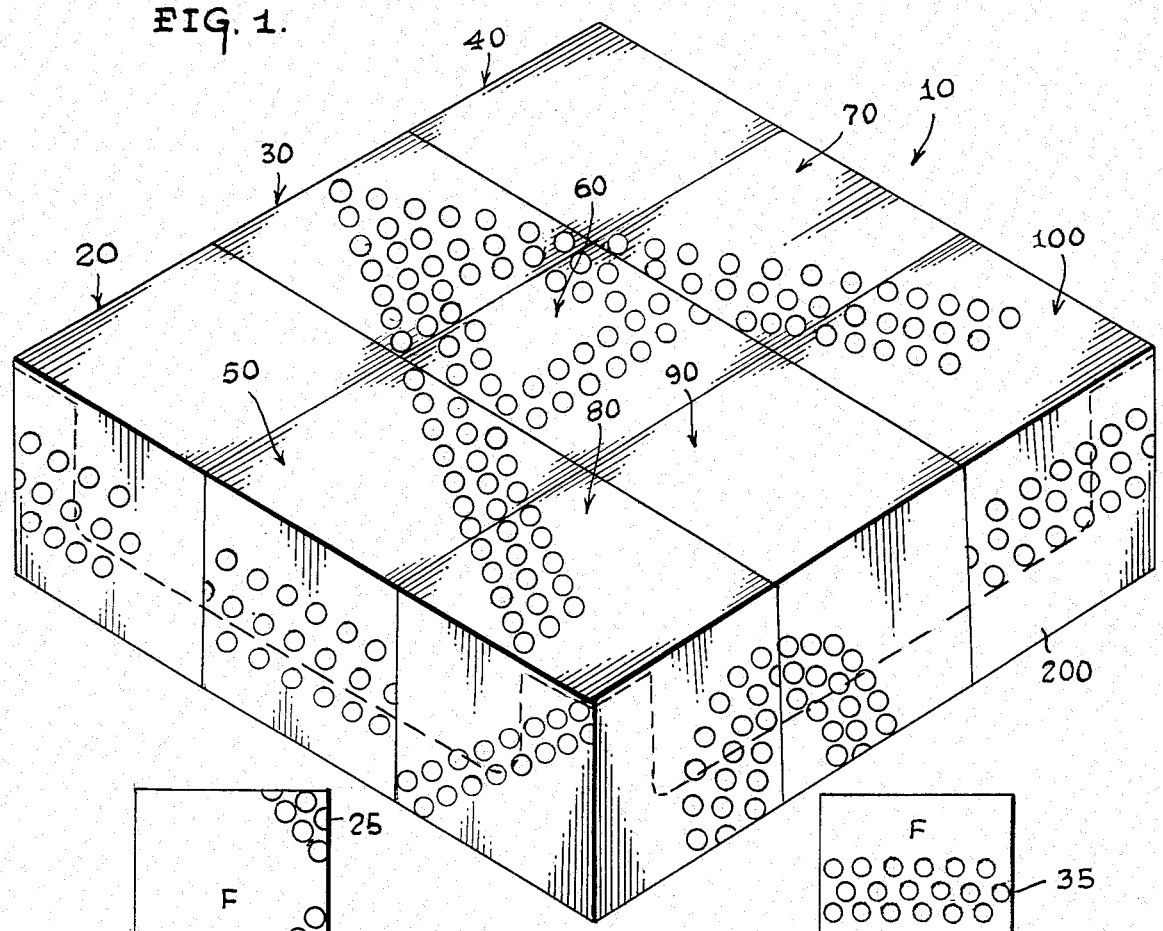
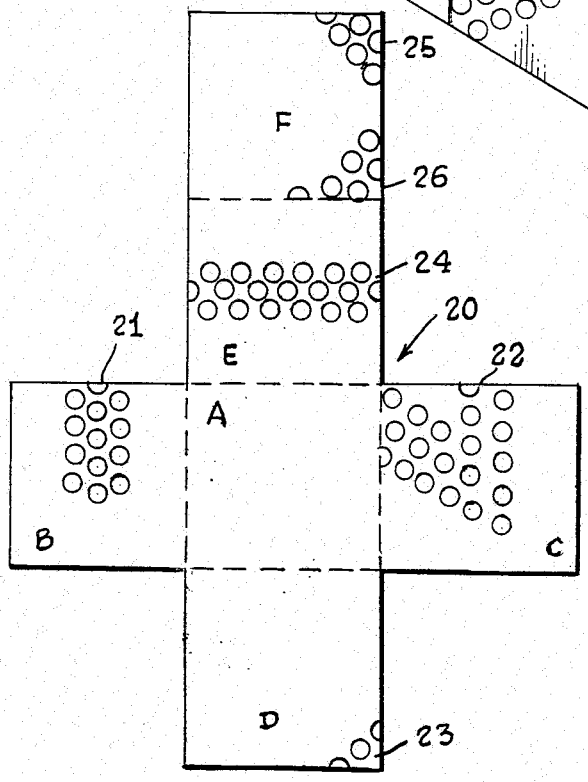
FIG. 2.
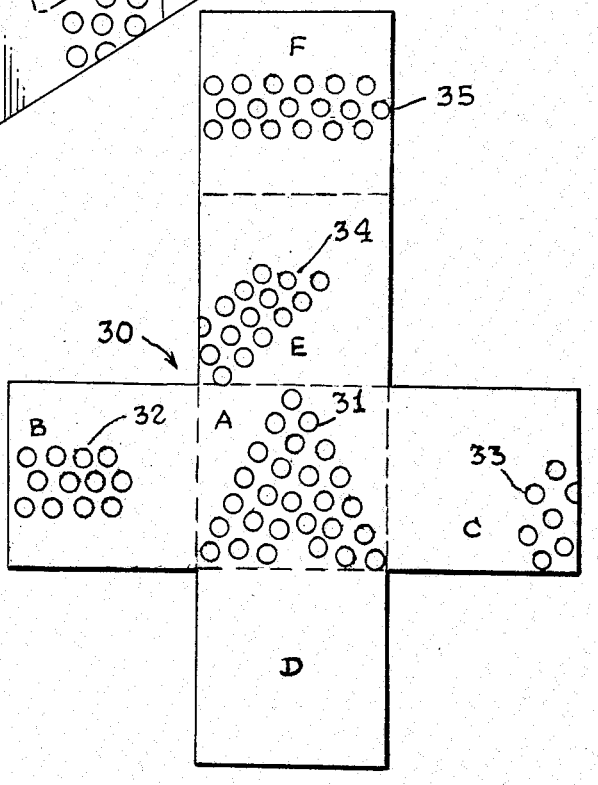
FIG. 3.

ALPHABET BLOCKS

BACKGROUND OF THE INVENTION

The prior art is replete with board games and educational puzzles that employ a plurality of blocks that can be arranged to produce a variety of patterns, as can be seen by reference to U.S. Pat. Nos. 3,759,522; 4,177,305; 4,177,993; and 4,076,253.

While the prior art devices all fulfill their intended roles and functions in a more or less satisfactory manner, they have been deficient in several regards; all of which can be directly attributable to their collective failure to appreciate the fact, that most children become bored with puzzles and other educational toys that do not maintain their interest.

A child has a very short attention span, and one of the easiest ways to lose that attention is to provide the child with a task that offers no challenge or is repetitive in nature.

As was evidenced by RUBIKS CUBE TM, a puzzle that offered numerous solutions among a multitude of variations, not only proved commercially successful, but also held childrens' attention far beyond the time span normally devoted to puzzles of this type.

The present invention, while based on different principles than the so called "cube" type puzzles, incorporates variations of those principles into a totally unique puzzle that also serves as an educational tool.

SUMMARY OF THE INVENTION

An object of the present invention is to provide a puzzle, that has as its primary objective the teaching of the alphabet to children, particularly pre-schoolers.

Another object of the present invention is to combine an educational tool with a puzzle that will extend a young child's attention span.

Still another object of the present invention is to develop a puzzle that can amuse and entertain children, that are even younger than the age group that the puzzle has been primarily developed for.

A further object of the present invention is to provide an educational tool, that will not only teach children the alphabet, but will also instruct and educate them as to spatial and dimensional relationships of objects, relative to one another, and to a grid system upon which the puzzle is based.

Yet another object of the present invention is the provision of a set of blocks that can be arranged to form a square, whose top surface consists only of a solid color, or whose top surface will contain indicia, which combine to form all of the letters of the alphabet.

A still further object of the present invention is to provide a set of blocks that in addition to the alphabet, can be arranged in an abstract pattern, and that pattern can contain all of the indicia to form a letter of the alphabet, when arranged properly with respect to one another.

These and other objects, advantages, and novel features of the invention will become apparent from the detailed description that follows, when considered in conjunction with the accompanying drawings.

BRIEF DESCRIPTION OF THE DRAWINGS

FIG. 1 is a perspective view of the nine blocks that comprise the puzzle arranged so that their top faces form the letter "A".

FIGS. 2 through 10 each illustrate the six faces of the nine individual blocks that comprise the puzzle.

DETAILED DESCRIPTION OF THE PREFERRED EMBODIMENT

Figure 4:
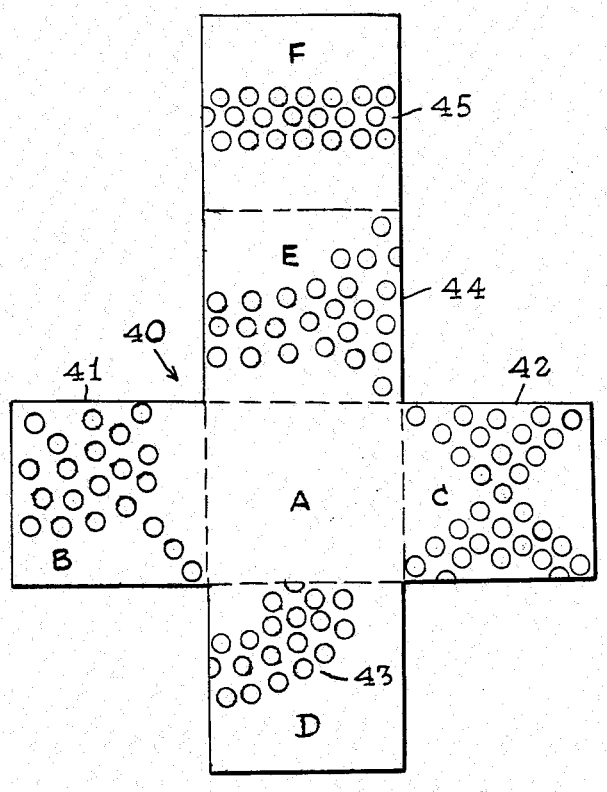

As can be seen by reference to FIG. 1, the puzzle is designated generally as 10, and comprises nine individual blocks numbered 20 through 100. As shown in FIG. 1, the blocks 20 through 100 have been oriented, so that their top surfaces bear indicia that form the letter "A".

Since each block has six sides designated by the letters "A" through "F", and all of the nine blocks are required to form one letter of the alphabet, and there are nine spaces in the grid and four possible orientations for each correct top surface within a given grid space, the maximum number of manipulations required to form each individual letter of the alphabet could reach a total of one thousand nine hundred forty four (1,944) manipulations.

While FIG. 1 illustrates the nine individual blocks combined, FIGS. 2 through 10 are two dimensional representations of the six sides of each individual block according to a given pattern. As can be seen from the drawings each face of individual blocks is designated by the letters "A" through "F".

The faces designated by the letter "A" represent the top faces of the individual cubes as they are illustrated in FIG. 1. The faces designated by the letter "F" represent the bottom faces of the blocks; and faces B, C, D, E, represent the left side, right side, front, and rear faces respectively of the individual blocks.

As can be seen by reference to FIG. 2, the six faces of block 20 bear indicia that conforms to the following patterns: face A is blank; face B has a half line 21 extending from the mid-point of one of the sides of the face; face C is provided with indicia 22 representative of a point of the letter "N"; face D has indicia 23 angled across one of the corners of the face; face E has a full line 24 extending from opposite sides of the face; and face F has indicia 25,26 angled across adjacent corners of the face.

As shown in FIG. 3, the six faces of block 30 bear indicia that conforms to the following pattern: face A is provided with the point 31 of the letter "A"; face B has a half-line extending from one side of the face; face C is provided in one corner with indicia 33 representative of the tail of the letter "G"; face D is blank; face E is provided with indicia 34 representative of one leg of the letter "X", which extends from one corner of the face; and face F has a full line 35 extending from opposite sides of the face.

Referring now to FIG. 4, the six faces of block 40 bear indicia that conforms to the following patterns: face A is blank; face B is provided with indicia 41 representative of the portion of the letter "Q" that bears the tail; face C is provided with indicia 42, representative of the juncture of the legs that form the letter "X"; face D has a curved line 43 extending from adjacent sides of the face; face E is provided with indicia 44 representative of the juncture of the legs that form the letter "Y"; and face F is provided with a full line that extends from opposite sides of the face.

Figure 5:
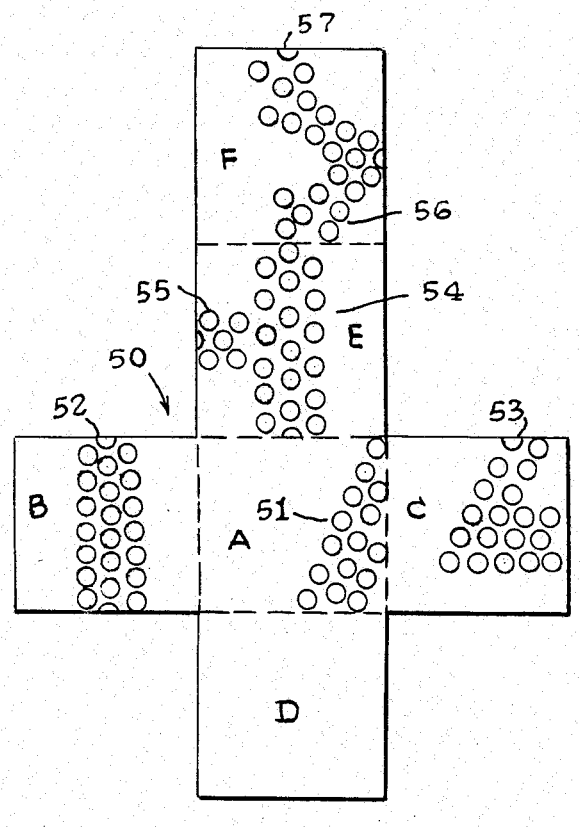

Turning now to FIG. 5, it can be seen that the six faces of block 50 bear indicia that conforms to the following pattern: face A is provided with indicia 51 representative of a portion of the leg on the left side of the letter "A"; face B is provided with a full line 52 extending from opposite sides of the face; face C is provided with indicia 53 representative of a point of the letter "N"; face D is blank; face E has a full line 54 extending from opposite sides of the face, that is intersected by a half-line 55 from one of the remaining sides; and face F has indicia in the form of two curved lines 56, 57 that originate on opposite sides of the face, and are joined and terminated on one of the remaining sides.

Figure 6:
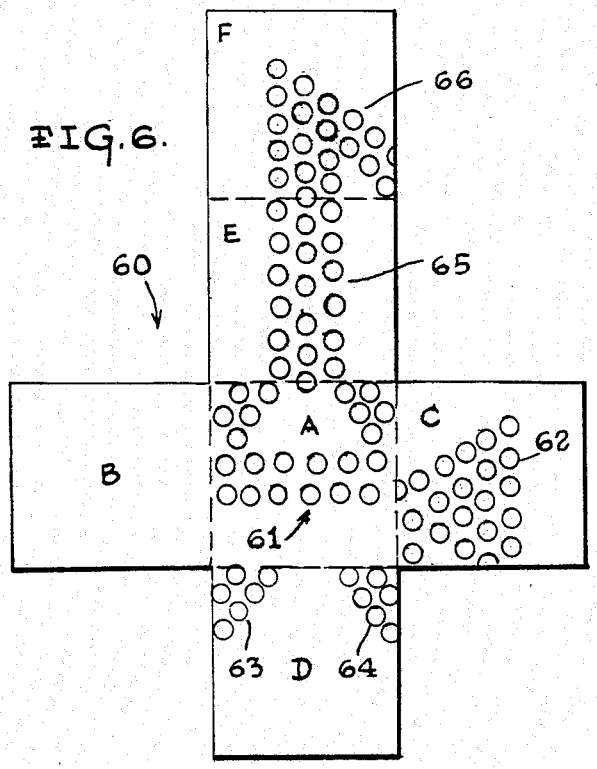

As shown in FIG. 6, the six faces of block 60 bear indicia that conforms to the following pattern: face A is provided with indicia 61 that is representative of the center of the letter "A"; face B is blank; face C is provided with indicia 62 that is representative of a point of the letter "N"; face D has indicia angled across adjacent corners of the face; face E has a full line 65 extending from opposite sides of the face; and face F is provided with indicia 66 that is representative of a point of the letter "Z".

Figure 7:
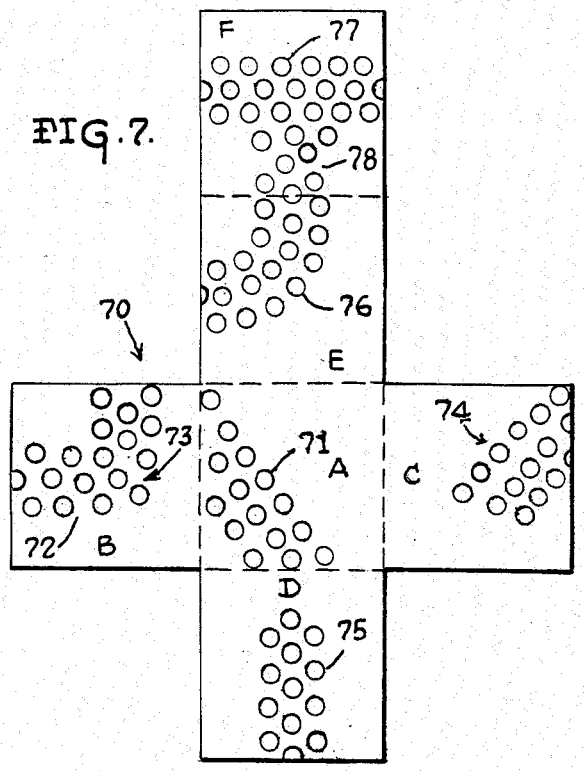
Figure 8:
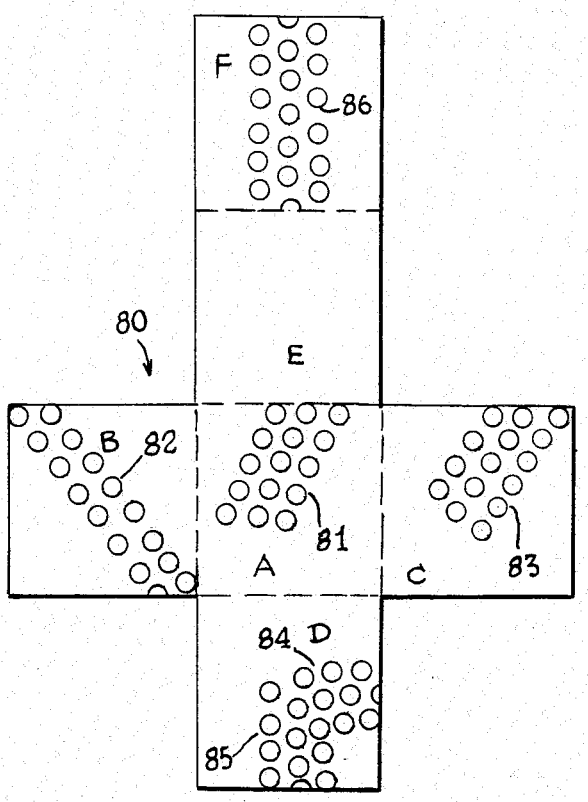

As can be seen by reference to FIG. 7, the six faces of block 70 bear indicia that conforms to the following pattern: face A is provided with indicia 71, that is representative of a portion of the right hand leg of the letter "A"; face B has two half lines 72, 73 that extend from adjacent sides of the face to form indicia representative of a right angle; face C is provided with indicia 74 representative of a leg of the letter "X"; face D has a half-line 75 extending from one of the sides of the face; face E has a curved line 76 that extends from two adjacent sides of the face; and face F has a full line 77 that extends from opposite sides of the face, and a half-line 78 that intersects the full line 77, and originates from one of the remaining sides.

Figure 9:
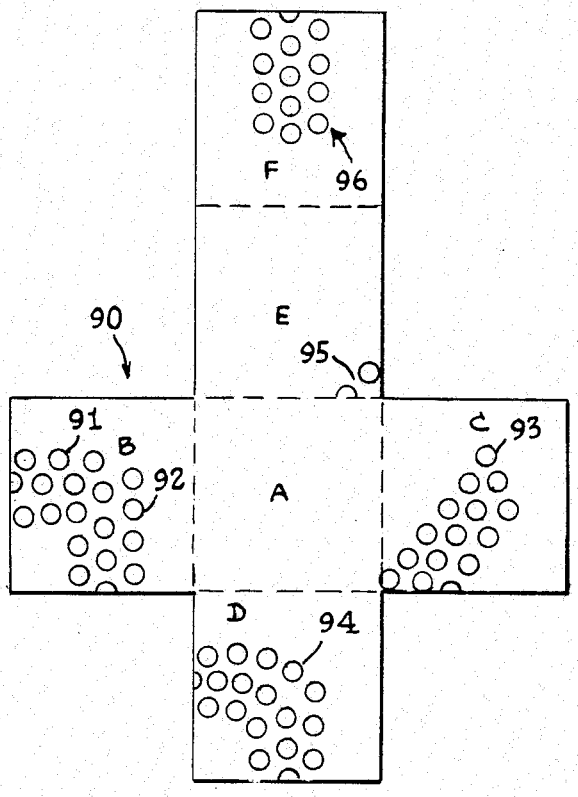

As shown in FIG. 9, the six faces of block 90 are provided with indicia that conforms to the following pattern; face A is blank; face B has has two half-lines 91, 92 that extend from adjacent sides of the face, to form indicia representative of a right angle; face C is provided with indicia 93 representative of a leg of the letter "X"; face D has a curved line 94 extending from adjacent sides of the face; face E has indicia 95 angled across one of the corners of the face; and face F has a half-line 96 extending from one of the sides of the face.

Figure 10:
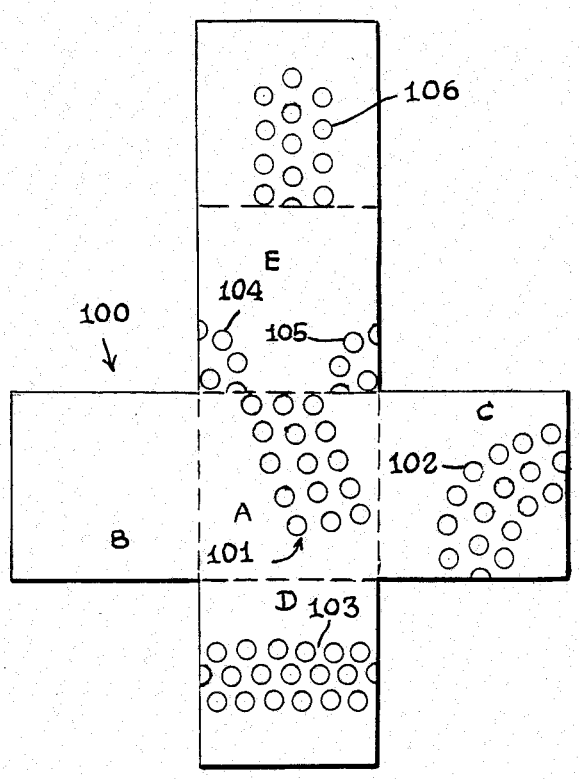

Turning now to FIG. 10, it can be seen that the six faces of block 100 are provided with indicia that conforms to the following pattern: face A is provided with indicia 101 that is representative of a portion of the right side of the leg of the letter "A"; face B is blank; face C has a curved line 92 extending from adjacent sides of the face; face D has a full line 103 extending from opposite sides of the face; face E is provided with curved indicia 104, 105 in adjacent corners of the face; and face F has a half-line 106 extending from one of the sides of the face.

As shown in the drawings, the various indicia are formed by a plurality of colored dots 11 arranged in the patterns described. While this is the preferred manner of creating the indicia, solid colored lines (not shown) would also suffice. It should also be obvious that the blocks can be made one color, and the indicia would comprise a contrasting color. All of the indicia heretofore described, do not have to conform to the exact orientation specified with regard to the faces A through F; however, each of the six faces of the individual blocks should be provided with one of the patterns associated with the faces A through F.

As is best depicted in FIG. 1, the puzzle 10 is provided with a container 200 (shown in phantom), that is dimensioned to retain the blocks 20 through 100 in a grid pattern of three blocks across and three blocks down. The individual blocks are loosely received within the container 200, in order that they may be easily removed, manipulated, and rearranged within the confines of the container.

The selective manipulation and rearrangement of the blocks within the container can produce on the combined top surfaces of the blocks the entire alphabet from A through Z. In addition, the blocks can also be arranged, so that all of the top surfaces of the blocks contain indicia, that can be rearranged to form a specific letter of the alphabet, so as to form a simple version of the puzzle.

Obviously the use of bright contrasting colors for the dot array indicia, and the blocks per se, also allows a myriad number of abstract patterns to be formed on the top surface of the blocks, when they are randomly arranged. This feature of the puzzle will not only maintain the interest of children too young to comprehend the alphabet, but will also provide an added element of entertainment for children and adults capable of understanding the main purpose and function of the puzzle.

It is also contemplated that very faint markings (not shown) will be provided to identify the individual blocks (20 through 100) and their respective surfaces or faces (A thru F) as well as the individual squares (1 thru 9) that comprise the grid pattern so that a printed description of the position of one of the faces of an individual block within the grid pattern can be provided for all of the letters of the alphabet. The printed solution will be extremely helpful to educators and parents alike, in arranging the blocks into a given letter of the alphabet, without having to go through the trial and error routine normally associated with this puzzle. The instructions may either be printed on the bottom of the container 200, so that they can never be misplaced, or optionally and less desirably on a separate piece of paper.

Having thereby described the subject matter of this invention, it should be obvious that many substitutions, modifications, and variations of the invention are possible in light of the above teachings. It is therefore to be understood that the invention as taught and described is only to be limited to the extent of the breadth and scope of the appended claims.

What I claim is:

1. An educational puzzle comprising nine individual blocks, adapted to be arranged into a grid pattern of three blocks down and three blocks across, and each individual block having six faces, wherein at least five of the six faces of each block are provided with indicia, that may be selectively arranged in the grid pattern, to form all twenty-six of the individual letters of the alphabet, on the combined top surfaces of the nine blocks; wherein each individual letter as represented by the upwardly turned faces of the nine blocks is devoid of portions of any other letter outside of the contiguous form of the letter being represented.

2. An educational puzzle as in claim 1; wherein, at least eight of the nine blocks are provided with a blank face.

3. An educational puzzle as in claim 2; wherein, at least seven of the nine blocks are provided with indicia on one of their six faces in the form of a full line that extends from opposite sides of the said one face.

4. An educational puzzle as in claim 3; wherein, at least five of the nine blocks are provided with indicia on one of their six faces in the form of a half-line that extends from one side of the said one face.

5. An educational puzzle as in claim 3; wherein, at least four of the nine blocks are provided with indicia, on one of their six faces, in the form of a curved line that extends from adjacent sides of the face.

6. An educational puzzle as in claim 5; wherein, at least four of the nine blocks are provided with indicia on one of their six faces representative of one of the legs of the letter "X".

7. An educational puzzle as in claim 6; wherein, at least three of the nine blocks are provided with indicia on one of their six faces representative of a point on the letter "N".

8. An educational puzzle as in claim 7; wherein, at least three of the nine blocks are provided with indicia on one of their six faces in the form of two half lines that extend from adjacent sides of the face to form a right angle.

9. An educational puzzle as in claim 8; wherein, at least two of the nine blocks are provided with indicia on one of their six faces in the form of a full line that extends from opposite sides of the face, and a half-line that intersects the said full line and extends from one of the remaining sides of the face.

10. An educational puzzle as in claim 9; wherein, at least two of the nine blocks are provided with indicia on one of their six faces in the form of angles formed in adjacent corners of the face.

11. An educational puzzle as in claim 10; wherein, at least two of the nine blocks are provided with indicia on one of their six faces representative of portions of the right hand leg of the letter "A".

12. An educational puzzle as in claim 11; wherein, at least two of the nine blocks are provided with indicia on one of their six faces representative of portions of the left hand leg of the letter "A".

13. An educational puzzle as in claim 12; wherein, at least one of the faces of one of the blocks is provided with indicia representative of the point of the letter "A".

14. An educational puzzle as in claim 13; wherein, at least one of the faces of one of the blocks is provided with indicia representative of the juncture of the legs of the letter "X".

15. An educational puzzle as in claim 14; wherein, at least one of the faces of one of the blocks is provided with indicia representative of the juncture of the legs of the letter "Y".

16. An educational puzzle as in claim 15; wherein, at least one of the faces of one of the blocks is provided with indicia representative of the center of the letter "A".

17. An educational puzzle as in claim 16; wherein, at least one of the faces of one of the blocks is provided with indicia representative of one of the points of the letter "Z".

18. An educational puzzle as in claim 17; wherein, at least one of the faces of one of the blocks is provided with indicia representative of the tail of the letter "G".

19. An educational puzzle as in claim 18; wherein, at least one of the faces of one of the blocks is provided with indicia representative of the portion of the letter "Q" that bears the tail.

20. An educational puzzle as in claim 19; wherein, at least one of the faces of one of the blocks has a full line extending from opposite corners of the face.

21. An educational puzzle as in claim 20; wherein, at least one of the faces of one of the blocks is provided with indicia angled across one corner of the face.

22. An educational puzzle as in claim 21; wherein, at least one of the faces of one of the blocks is provided with indicia that form curves in two adjacent corners of the face.

23. An educational puzzle as in claim 22; wherein, at least one of the faces of the blocks is provided with indicia that forms a curve in one corner of the face.

24. An educational puzzle as in claim 23; wherein, one of the faces of one of the blocks has two curved lines that originate on opposite sides of the face, and which are joined and terminate at one of the remaining sides of the face.

25. An educational puzzle as in claim 24, wherein, the blocks are one color and the indicia are a contrasting color.

26. An educational puzzle as in claim 25; wherein, the indicia comprises a plurality of colored dots.

27. An educational puzzle comprising nine individual blocks, adapted to be arranged into a grid pattern of three blocks down and three blocks across, wherein each individual block has six faces, for a total of fifty-four faces, and at least five of the six faces on each block are provided with indicia, that may be arranged in the said grid pattern to form all twenty-six of the individual letters of the alphabet, on the combined top surfaces of the nine blocks; wherein each individual letter as represented by the upwardly turned faces of the nine blocks is devoid of portions of any other letter, outside of the contiguous form of the letter being represented, and wherein the contiguous form of each letter is represented by a plurality of spaced dots.

28. An educational puzzle as in claim 27; wherein, the indicia on twenty two of the fifty four faces comprise:

seven faces that have a full line extending from opposite sides of each face five faces that have a half line extending from one of the sides of each face four faces that have a curved line extending from adjacent sides of each face three faces that have half lines extending from adjacent sides of each face to form right angles two faces that have a full line extending from opposite sides of each face, and a half line intersecting the full line, and extending from one of the remaining sides of each face, and one face has indicia angled across one corner of the face 29. An educational puzzle as in claim 28; wherein the indicia on at four of the fifty four faces are representative of the legs of the letter "X".

30. An educational puzzle as in claim 29; wherein the indicia on at least three of the fifty four faces are representative of a point on the letter "N".

* * * * *